US006540384B1

(12) United States Patent
Rosevear

(10) Patent No.: US 6,540,384 B1
(45) Date of Patent: Apr. 1, 2003

(54) SNOWBOARD LIGHT

(76) Inventor: Jeffrey Rosevear, 309 Henderson Dr., San Jose, CA (US) 95123

( * ) Notice: Subject to any disclaimer, the term of this patent is extended or adjusted under 35 U.S.C. 154(b) by 0 days.

(21) Appl. No.: 09/595,478

(22) Filed: Jun. 16, 2000

(51) Int. Cl.[7] ..... F21V 21/00

(52) U.S. Cl. ..... 362/486; 362/459; 362/190; 362/191; 362/368

(58) Field of Search ..... 362/459, 529, 362/531, 253, 191, 190, 368, 371

(56) References Cited

U.S. PATENT DOCUMENTS 4,399,498 A * 8/1983 Bacevius ..... 362/191 X
5,738,432 A * 4/1998 Okko et al. ..... 362/103
5,889,627 A * 3/1999 Brady et al. ..... 362/459 X

* cited by examiner

*Primary Examiner*—Sandra O'Shea
*Assistant Examiner*—Anabel Ton
(74) *Attorney, Agent, or Firm*—Carol D. Titus; Gregory Smith & Associates

(57) ABSTRACT

Snowboard Light with a centrally located hollow housing containing a light source, a reflector, a clear lens, a battery supply, an attachment means, an on off switch, and a battery door. A pair of semi rigid mirror image side members are hingably connected to either side of the central chamber. The side members have a recessed groove capable of accepting the edge of a snowboard. Said side members have inwardly facing straps and corresponding attachment means to secure said snowboard light to said snowboard. A preferred embodiment includes wherein said lens is a fresnel lens capable of collumnating a light beam. Said light beam being vertically adjustable by means an adjustment knob.

19 Claims, 4 Drawing Sheets

SNOWBOARD LIGHT

BACKGROUND OF THE INVENTION

This invention relates generally to the field of battery operated lights, and more particularly to a snowboard light.

Snowboards have been a new variation on snow skis for the last fifteen years. The sport combines the skills of surfing with the skills of skiing and has become very, popular in recent years.

Snowboards are generally a singular flat board with upwardly sloping tips at the front and rear of the board. The width of the board and the curve of the tips can vary slightly. The user clamps his or her boots into bindings that are firmly attached to the center of the board so that the user is standing in a sideways position with respect to the board. When snowboarding under adverse conditions such as dusk or night time or during a period of fog or heavy snow, a person can find it difficult to see very far in front of the board. In these situations it would be beneficial to have a light mounted to the board that could help the user see ahead more clearly.

SUMMARY OF THE INVENTION

The primary object of the invention is provide an attachable and removable light that will improve visibility while snowboarding in adverse conditions.

Another object of the invention is to be easily attached to and removed from any snowboard regardless of the width or tip configuration of the board.

Another object of the invention is to provide a beam of white and/or blue light.

A further object of the invention is to have an attachable lens to produce a beam of yellow light.

Yet another object of the invention is to provide an attachable snowboard light that is relatively light weight and thin.

Still yet another object of the invention is to provide a recharging means for the battery supply.

Another object of the invention is to be able to adjust the angle of the direction of the light of the present invention.

Another object of the invention is that the device be water resistant.

Another object of the invention is that the device be easy to turn on and off even with gloved hands.

Other objects and advantages of the present invention will become apparent from the following descriptions, taken in connection with the accompanying drawings, wherein, by way of illustration and example, an embodiment of the present invention is disclosed.

The present invention takes the form of a snowboard light comprising: a centrally located housing containing a light source, a reflector, a fresnel lens, a battery supply, an attachment means, an on off switch, and a battery door and a pair of mirror image, semi rigid side members that are hingably connected to either side of said central chamber, said side members having an inwardly facing recessed groove capable of accepting the edge of a snowboard, said side members having inwardly facing straps and corresponding attachment and releasing means to secure said snowboard light to said snowboard. The angle of the light source is adjustable by the user.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
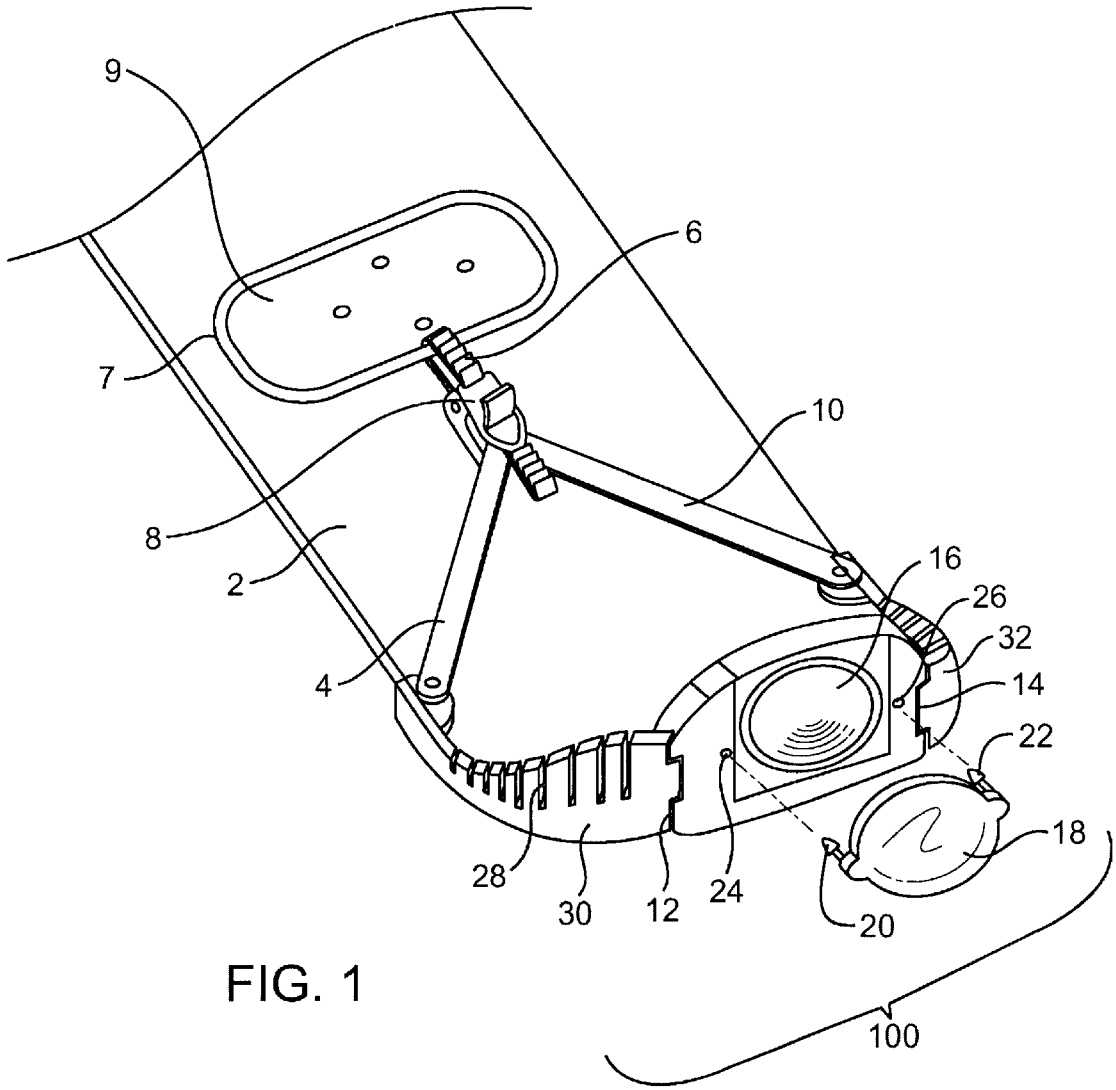
FIG. 1 is a perspective view of the snowboard light of the present invention.

Referring now to FIG. 1, we see a perspective view of the snowboard light of the present invention 100. Central housing 24 is mounted on the center front edge of the snowboard 2. Side members 30, 32 wrap around the side edges of the snowboard 2. Side members 30, 32 have vertical slots 28 so that the semi rigid molded plastic material can flex slightly to accommodate boards of different curves. Side members 30, 32 are hinged at the side 12, 14 of central housing 24. Lens 16 is a fresnel lens so that the light emitted is columnated in nature. Removable and attachable auxiliary lens 18 is tinted yellow which is a color that can help the user to see more easily in a snow storm and other adverse conditions. Lens 18 has a pair of barbed male connecters 20, 22 that are inserted into receptacles 25, 26. Straps 4, 10 are attached at one end to side members 30, 32 and terminate at ratchet strap 6 and ratchet retaining buckle 8. In the preferred embodiment, straps 4, 10 are constructed of non elastic nylon. However, in an alternate embodiment, straps 4, 10 may be constructed of an elastic material so that they may automatically adjust in length in reference to snowboard 2, as snowboard 2 flexes during use. This ratcheting design is similar to that found on bindings of snowboards and causes straps 4, 10 to be under considerable tension thereby reducing the chance of having the snowboard light 100 shaken off the snowboard 2 during operation. Ratchet strap 6 is attached to plate 7 that is placed under binding retaining plate 9 found on all snowboards.

Figure 2:
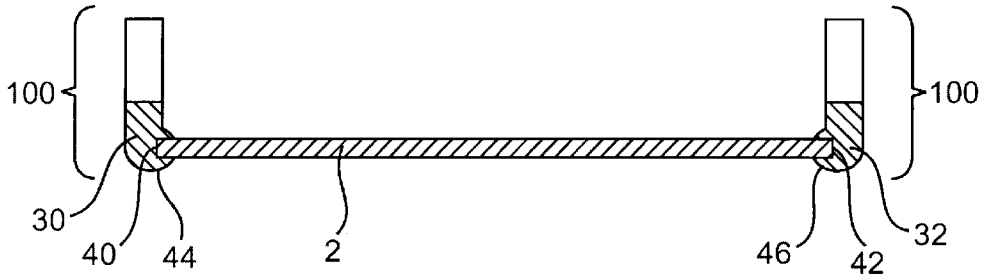
FIG. 2 is a cross-sectional view of the snowboard and side members of the present invention.

FIG. 2 shows a cross section of snowboard 2 with side members 30, 32 in place. Side members 30, 32 have inwardly facing grooves 40, 42 that accept the edge of snowboard 2. The bottom surfaces 44, 46 of side members 30, 32 terminate as the snowboard 2 flattens, as shown in FIG. 3, thereby precluding the chance of rails 44, 46 negatively affecting the performance of the board 2 while in operation.

Figure 3:
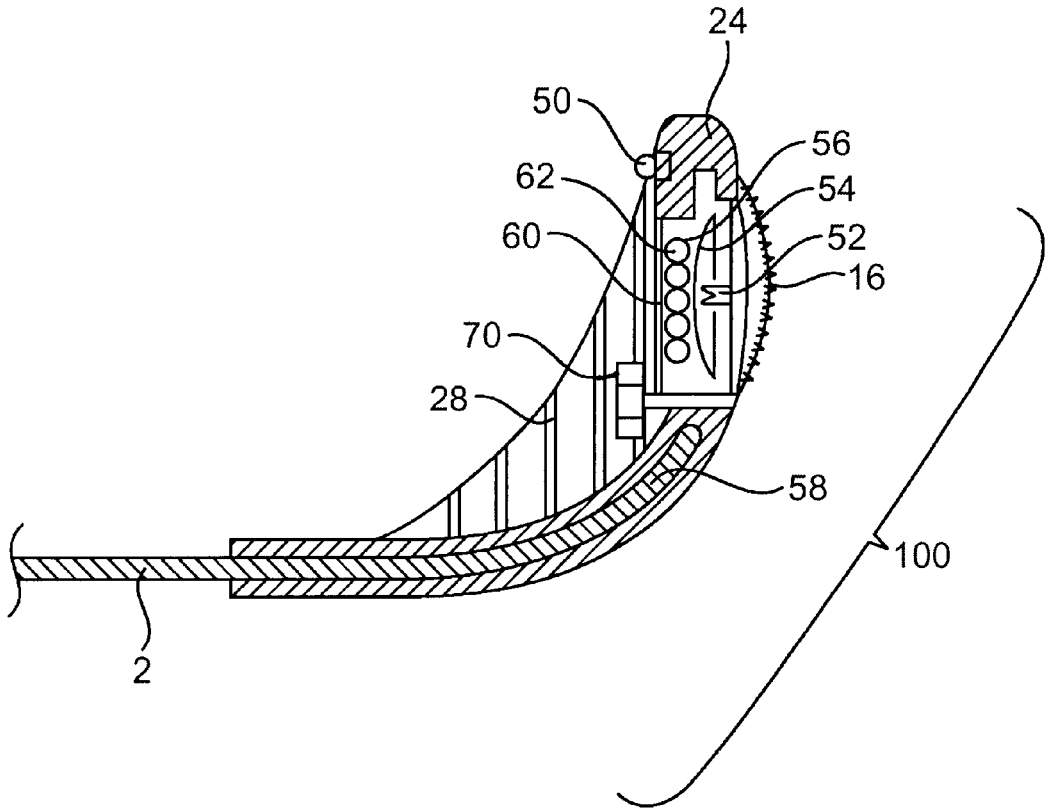
FIG. 3 is side section view of the snowboard light of the present invention.
Figure 4:
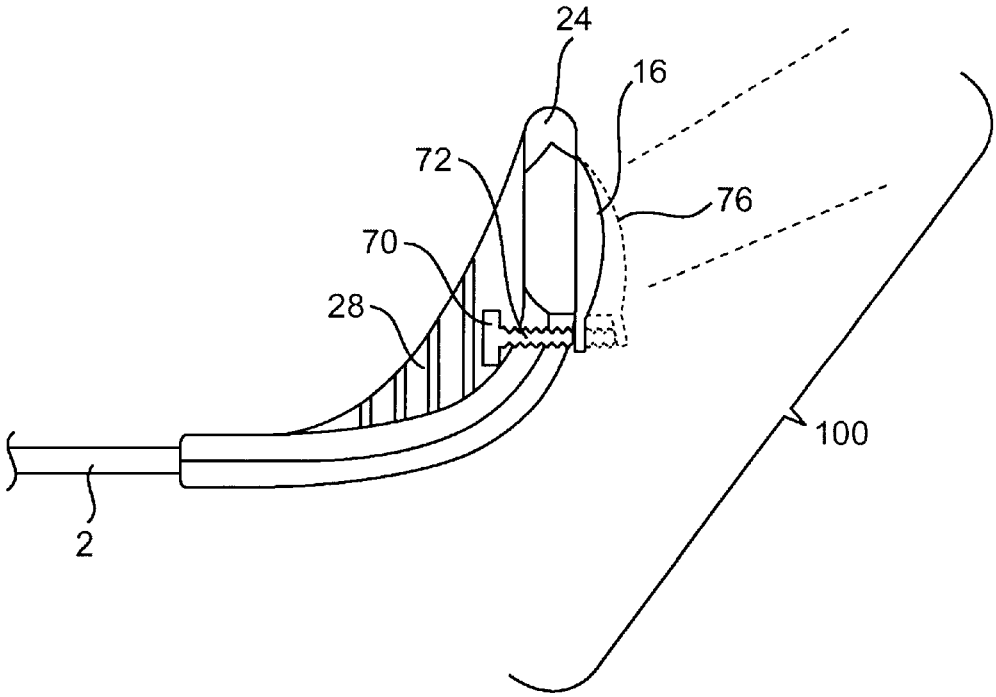
FIG. 4 is a side section view showing the vertical adjustability of light beam.

FIG. 3 shows a side section of the snowboard light of the present invention 100. Vertical grooves 28 allow semi rigid side members to flex so that they can accommodate curved section 58 of board 2 regardless of variations of the curve from board to board. The contents of central housing 24 can be seen. Fresnel lens 16 covers the front of housing 24. Reflector 54 and light source 52 are behind lens 16. Battery supply 56 is behind reflector 54. Batteries 56 are removable and replaceable by removing battery door 60. Switch 50 is easily accessable and can be operated even when the user is wearing a heavy glove. The entire central housing 24 and switch 50 is constructed in such a way that water cannot easily penetrate to the interior of housing 24. Receptacle 62 can accept a plug from an AC to DC power transformer, which can act as a charging means for batteries 56. FIG. 4 shows that angle adjustment knob 70 is threaded into a light surround frame 24. When knob 70 is rotated, it can push the lamp housing and fresnel lens 16 outward and upward thereby changing the angle of the projection of the light as shown by dotted line 76. This adjustment is helpful when snowboarding in deep snow.

In this way a person can attach a battery operated light to a snowboard for use during adverse skiing conditions. The snowboard light of the present invention is of a semi rigid construction and can flex to fit onto a variety of shaped boards. The entire assembly is relatively light weight and thin. It is also water resistant and can be operated even while wearing heavy gloves. It is also obvious that the mounting structure of the present invention could be used for other purposes such as holding a video camera, film camera, digital camera or the like in place of the light of the present invention.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A snowboard light configured for connection with a snowboard comprising:

a central housing;

a light source;

a reflector located behind said light source;

a fresnel lens covering a front of said central housing;

a battery supply connected to said light source;

an attachment means for attaching said central housing to the snowboard;

an on off switch controlling said light source; and a battery door covering said battery supply;

said housing being hollow and capable of holding said light source, said reflector, said battery supply, said battery door, and said switch; said housing being angularly adjustable by means of an adjustment knob pushing an integral threaded post towards a bottom edge of said central housing;

and a pair of mirror image, semi rigid side members hingably connected to either side of said central housing, said side members having a recessed groove capable of accepting an edge of the snowboard, said side members having inwardly facing straps and corresponding attachment means to secure the snowboard light to a plate that mounts under a binding retaining plate of the snowboard.

2. The snowboard light as claimed in claim 1, wherein said fresnel lens is capable of columnating a light beam.

3. The snowboard light as claimed in claim 1, wherein said side members have a plurality of vertical grooves allowing said side members to flex slightly thereby accommodating snowboards of different curvatures.

4. The snowboard light as claimed in claim 1, wherein said fresnel lens can be supplemented with an attachable and removable yellow tinted lens.

5. The snowboard light as claimed in claim 1, wherein said snowboard light assembly is water resistant.

6. The snowboard light as claimed in claim 1, wherein said battery supply can be recharged by a separate charging unit that can plug into said snowboard light.

7. The snowboard light of claim 8, wherein the adjustability of said housing is achieved with an adjustment knob on said housing pushing an integral threaded post towards a bottom edge of said housing.

8. A snowboard light configured for connection with a snowboard, the snowboard light comprising:

a light source, and an angularly adjustable housing holding said light source, said housing sized and configured to connect to a snowboard, wherein said housing is attachable to the snowboard by a pair of side members hingably connected to either side of said housing, said side members having a recessed groove capable of accepting an edge of the snowboard, said side members having inwardly facing straps to secure said snowboard light to a plate that mounts under a binding retaining plate of the snowboard.

9. The snowboard light of claim 8 wherein the adjustability of said housing is achieved with an adjustment knob on said housing pushing an integral threaded post towards a bottom edge of said housing.

10. The snowboard light of claim 9, further comprising a fresnel lens.

11. The snowboard light of claim 9, further comprising a battery supply contained within said housing.

12. The snowboard light of claim 9, further comprising a reflector located behind said light source.

13. The snowboard light of claim 8, wherein said side members are semi rigid.

14. The snowboard light of claim 8, wherein said side members have a plurality of vertical grooves allowing said side members to flex slightly thereby accommodating snowboards of different curvatures.

15. In combination:

a snowboard, and a snowboard light, comprising:

a light source, and a housing holding said light source, said housing sized and configured to connect to said snowboard.

16. The combination of claim 15, wherein said housing is angularly adjustable.

17. The combination of claim 14, wherein the adjustability of said housing is achieved with an adjustment knob on said housing pushing an integral threaded post towards a bottom edge of said housing.

18. The combination of claim 14, wherein said housing is attachable to the snowboard by a pair of side members hingably connected to either side of said housing, said side members having a recessed groove capable of accepting an edge of the snowboard, said side members having inwardly facing straps to secure said snowboard light to a plate that mounts under a binding retaining plate of the snowboard.

19. The snowboard light of claim 15, further comprising a battery supply contained within said housing.

* * * * *